US010377149B2

(12) United States Patent
Veis et al.

(10) Patent No.: US 10,377,149 B2
(45) Date of Patent: Aug. 13, 2019

(54) PRINTING PROTECTIVE COATINGS

(71) Applicant: Hewlett-Packard Industrial Printing LTD, Netanya (IL)

(72) Inventors: Alex Veis, Kadima (IL); Ran Vilk, Qiryat Ono (IL); Tamir Daya, Netanya (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 15/278,146

(22) Filed: Sep. 28, 2016

(65) Prior Publication Data

US 2017/0096018 A1 Apr. 6, 2017

(30) Foreign Application Priority Data

Oct. 2, 2015 (EP) ..... 15188254

(51) Int. Cl.

| | |
|---|---|
| ***B41J 11/00*** | (2006.01) |
| ***B41M 7/00*** | (2006.01) |
| *B41J 2/21* | (2006.01) |

(52) U.S. Cl.

CPC ..... *B41J 11/0015* (2013.01); *B41M 7/0036* (2013.01); *B41J 2/2114* (2013.01); *B41M 7/0045* (2013.01); *B41M 7/0054* (2013.01)

(58) Field of Classification Search

None

See application file for complete search history.

(56) References Cited

U.S. PATENT DOCUMENTS

| | | | | |
|---|---|---|---|---|
| 6,160,046 | A | 12/2000 | Bleikolm et al. | |
| 7,037,398 | B2 | 5/2006 | Kwasny et al. | |
| 8,608,272 | B2 * | 12/2013 | Lang | B41J 2/1755 347/15 |
| 2007/0048480 | A1 * | 3/2007 | Lavosky | G09F 3/10 428/40.1 |
| 2008/0248261 | A1 | 10/2008 | Bonnett et al. | |
| 2009/0255460 | A1 | 10/2009 | Castelli et al. | |
| 2010/0285281 | A1 * | 11/2010 | Mashtare | B41J 3/38 428/195.1 |
| 2012/0139984 | A1 | 6/2012 | Lang | |
| 2012/0207887 | A1 | 8/2012 | Battersby | |

FOREIGN PATENT DOCUMENTS

| | | |
|---|---|---|
| CN | 101041386 | 9/2007 |
| CN | 101284431 | 10/2008 |
| CN | 102548753 | 7/2012 |
| CN | 102555372 | 7/2012 |
| EP | 1247588 | 10/2002 |
| EP | 2111985 | 10/2009 |
| WO | WO-2009130078 | 10/2009 |

OTHER PUBLICATIONS

Savanholm, Erik—"Printability and Ink-Coating Interactions in Inkjet Printing"—Dissertation—Karlstad University Studies—2007—58 pages.

* cited by examiner

*Primary Examiner* — Erica S Lin

(74) *Attorney, Agent, or Firm* — HP Inc. Patent Department

(57) ABSTRACT

A method of printing a print media comprises printing an image onto a surface of a print media, and applying a protective coating over the surface of the print media using an analog printing process, wherein the protective coating comprises a plurality of micro openings.

20 Claims, 3 Drawing Sheets

PRINTING PROTECTIVE COATINGS

An emerging printing market is that of the digital packaging market, whereby a media used for packaging is printed, for example using digital printing, technologies. The media may be printed prior to the media being formed or shaped into a packaging item, or as part of the packaging process per se.

Printing media used for packaging, can become damaged or scratched during the box preparation, packaging and transportation processes. For example the ink on the printed areas can become damaged, smudged or scratched. Media (e.g. paper) may also need to be protected in some cases. Clay coated paper is commonly used in printing, which can be easily scratched during the above processes.

BRIEF DESCRIPTION OF THE DRAWINGS

For a better understanding of examples described herein, and to show more clearly how the examples may be carried into effect, reference will now be made, by way of example only, to the following drawings in which.

DETAILED DESCRIPTION

Figure 1:
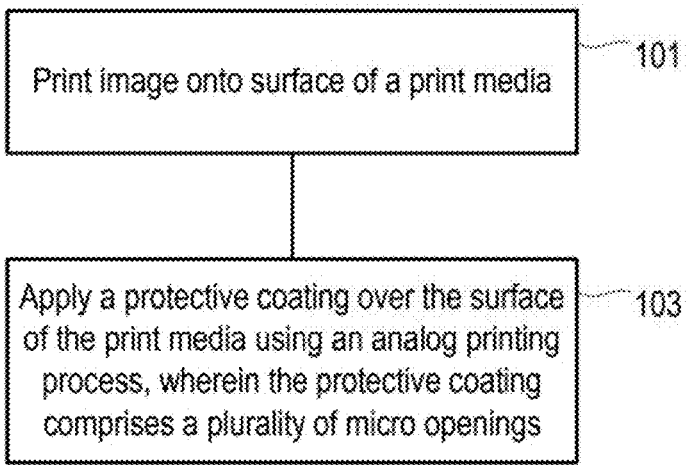
FIG. 1 shows an example of a method according to the present disclosure.

FIG. 1 shows an example of a method of printing a print media. The method comprises printing, 101, an image onto a surface of a print media. The method further comprises applying, 103, a protective coating over the surface of the print media using an analog printing process, wherein the protective coating comprises a plurality of micro openings.

By applying a protective coating having a plurality of micro openings, the protective coating can act to protect the print media from subsequent damage (such as scratching, e.g. during subsequent handling), yet also assist in other ways with any subsequent processing stages. For example, if a subsequent coating, for example a glue or adhesive is to be applied to at least a portion of the print media, e.g. when the print media is subsequently being used to form a packaging product, the sparse protective coating (formed by the micro openings) allows a glue or adhesive to penetrate the protective coating and adhere to non-protected portions of the print media, for gluing the packing product together, i.e. via the plurality of micro openings. In some examples this can enable standard or lower cost adhesives to be used.

A protective coating comprising a plurality of micro openings also provides a sparse coating such that less protective coating is used in the printing process.

In some examples the plurality of micro openings are discrete openings. In other examples at least some of the micro openings may be interlinked, for example such that they form an area of co-joined micro openings.

In one example, applying a protective coating comprises distributing the plurality of micro openings over the surface of the print media in an even manner, or using a repeating pattern, or using an even average density, or throughout the layer of the protective coating.

The method may comprise configuring the plurality of micro openings such that the protective coating is deposited on a predetermined percentage of the surface area of the print media. In one example the method comprises depositing a protective coating, with the plurality of micro openings being configured such that a protective coating remains on about 30% of the surface area of the print media. It is noted, however, that other examples may have different percentages of the surface area covered with a protective coating, for example based on a particular application. In some examples the method comprises configuring the plurality of micro openings such that the protective coating deposits on 10% to 70% of the surface area of the print media.

FIGS. 2*a* to 2*f* show examples of printing patterns that may be used to deposit the protective coating, such that the protective coating covers a predetermined percentage of the surface area of the print media, according to the micro openings provided.

In FIGS. 2*a* to 2*d*, in some examples the light areas relate to micro openings in the protective coating, with the dark areas relating to the protective coating itself. In other examples the reverse may be used, i.e. whereby the dark areas relate to micro openings in the protective coating, with the light areas relating to the protective coating itself.

Figure 2A:
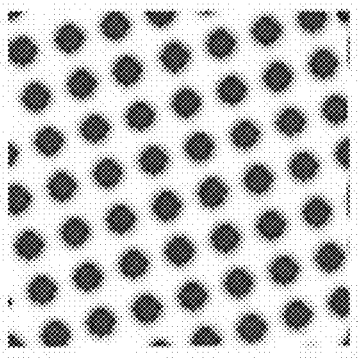
FIGS. 2*a* to 2*f* show examples of protective coatings according to the present disclosure.

Referring to FIG. 2*a* (and assuming the former, i.e. whereby the light areas relate to the plurality of micro openings), this shows an example of an array of printed dots or droplets of protective material, the array of printed dots or droplets of protective material forming the protective coating having the plurality of micro openings therein. In such an example the plurality of micro openings are interlinked, such that they form an overall co-joined or combined area not having any protective coating.

In one example the size of each printed dot in the array and/or the respective spacing between printed dots in the array contributes to the predetermined percentage of the surface area of the print media being covered by a protective coating.

Figure 2B:
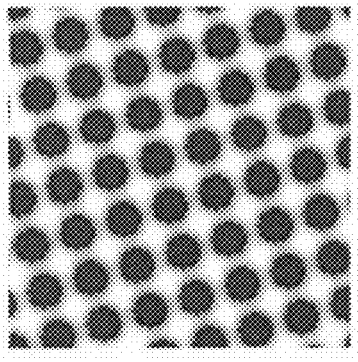

In the example of FIG. 2*a*, the printed dots are deposited such that the protective coating is applied to a predetermined percentage of the surface a of the print media. FIG. 2*b* shows another example, whereby the printed dots of protective coating are larger than that of FIG. 2*a*, such that a greater percentage of the surface area of the print media is covered by a protective coating. In some examples the size and spacing or frequency of the printed dots may vary, for example, from 20 to 200 dpi.

It is noted that although FIGS. 2*a* and 2*b* illustrate protective dots which are generally circular in shape, in other examples the printed dots can be any shape, including elliptic, square, lines or crosses, or even random patterns not having any defined shape. As such, it follows that the micro openings can also take any shape.

Furthermore, although FIGS. 2*a* and 2*b* show examples in which the plurality of micro openings are configured such that they provide an array of printed dots of protective coating of substantially equal size, and evenly spaced in a regular fashion, it is noted that an array may comprise different sized printed dots, or different spacing in different areas. For example, if a particular portion of the print media would benefit from having a higher level of protection compared to other areas (for example an area which is more likely to be scratched or damaged during subsequent processing or handling), that area can have a higher percentage of protective coating, or vice versa. In another example, if a particular area is known to comprise a fixing portion (e.g. an area which is to receive a glue or adhesive), that area may be selected to comprise a lower percentage of protective coating, such that a glue Of adhesive can penetrate more readily, and adhere to non-protected portions of the print media.

Figure 2C:
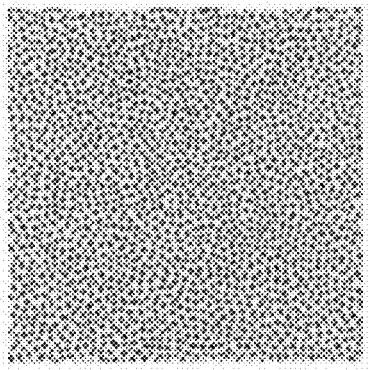
Figure 2D:
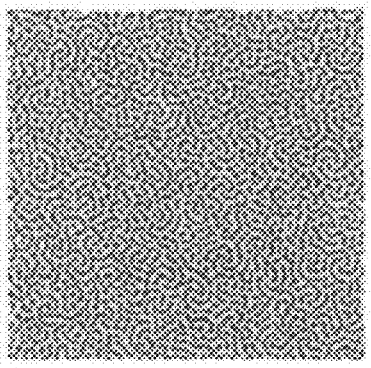

In other examples, for example as shown in FIGS. 2*c* and 2*d*, the plurality of micro openings are configured such that a desired percentage of protective coating may be achieved using a plurality of micro openings which result in a random pattern of protective coating.

Figure 2E:
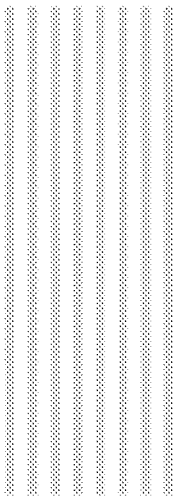
Figure 2F:
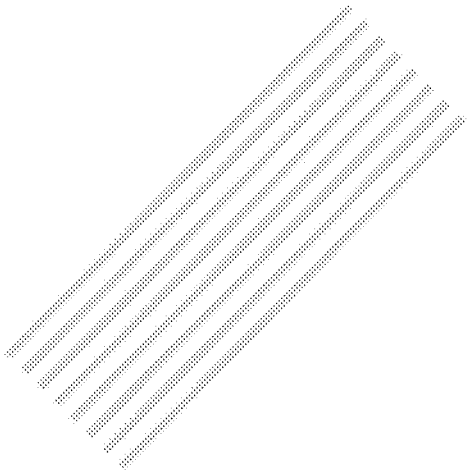

FIGS. 2*e* and 2*f* show yet further examples, whereby the micro openings are arranged as a series of lines, resulting in a protective coating comprising a series of lines. In FIG. 2*e* the micro openings are arranged to provide lines parallel with an edge of a print media (not shown, but which is assumed to be parallel with the page), whereas in FIG. 2*f* the micro openings are arranged to provide lines which are at an angle to an edge of a print media.

In some examples, the method comprises configuring the plurality of micro openings based on at least one of the following criteria: a print media type; a protective coating type; a subsequent coating type, wherein a subsequent coating is to be applied over at least a portion of the protective coating. Any combination of these criteria may be used to configure the plurality of micro openings, and thus determine the predetermined percentage of protective coating applied to the surface of the print media.

By selecting a degree of sparseness of protective coating according to any combination of these criteria, this enables the print media to be protected, while also allowing a subsequent coating layer, for example a glue or adhesive, to penetrate the protective coating and adhere to non-protected portions of the print media. It is noted that the subsequent coating layer, in another example, comprises a printed image over at least part of the protective coating, e.g. a printed use by date for a packaged product, or in another example a label applied onto the protective coating.

The criteria used for configuring the plurality of micro openings an therefore depend on a particular application.

In some examples, halftoning techniques may be used to control the printing process, for example to determine where printing fluid is to be deposited in a specific pattern in order to provide the plurality of micro openings, and/or the printed dots or lines of protective coating forming the plurality of micro openings. For example the halftoning techniques may be used to select the size and/or density of the printed dots or lines, (and hence the size and/or density of the plurality of micro openings). For example, an AM halftoning method (analogous to amplitude modulation), such as cluster dot screening, may be used to deposit the predetermined percentage of protective coating, for example by controlling the sizes of the printed dots or lines. In another example, FM halftoning techniques (analogous to frequency modulation) may be used to select the density of the printed dots or lines, for example using error diffusion techniques.

In some examples, the analog printing process comprises depositing the protective coating using a roller coating process, wherein the roller comprises a plurality of micro openings. In other examples, the analog printing process comprises depositing the protective coating using a mesh screen, wherein the mesh screen comprises a plurality of micro openings. The analog printing process may also comprise techniques such as a spray process. These roller, mesh, and spray techniques may also be referred to as flood printing techniques for protecting the print media, but where the flood printing process provides a plurality of micro openings in the protective coating.

In some examples the method of applying a protective coating comprises depositing a protective coating having a predetermined thickness to the surface area of the print media.

The predetermined thickness may be chosen or selected based on at least one of the following criteria: a print media type; a protective coating type; a subsequent coating type, wherein a subsequent coating is to be applied over at least a portion of the protective coating.

In one example, the thickness of protective coating may comprise a layer of 0.5 μm to 4 μm over the print media, for example 1 μm. It is noted that other thicknesses may also be used.

In some examples the method comprises depositing the protective coating to the whole surface of the print media. In other examples, the method comprises depositing the protective coating to at least a portion of the surface of the print media not having an image previously printed thereon, e.g. just to non-imaged regions. Such an example may be used where a printing fluid (e.g. an ink) that is used for printing an image is itself sufficiently durable to prevent the image from being scratched or damaged during subsequent handling, thereby enabling the protective coating to be applied to other areas (e.g. blank areas) of the print media not having an image printed thereon, for protecting such other areas.

Figure 3:
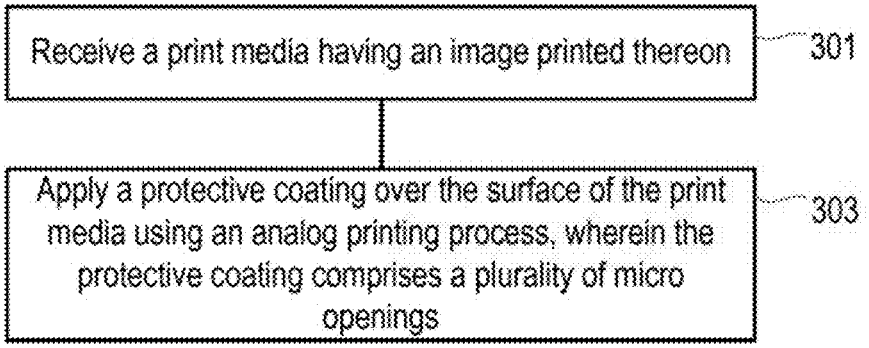
FIG. 3 shows an example of another method according to the present disclosure.

FIG. 3 shows a method according to another example. The method of FIG. 3 comprises receiving, 301, a print media having an image printed thereon. The method further comprises applying, 303, a protective coating over the surface of the print media using an analog printing process, wherein the protective coating comprises a plurality of micro openings.

Figure 4:
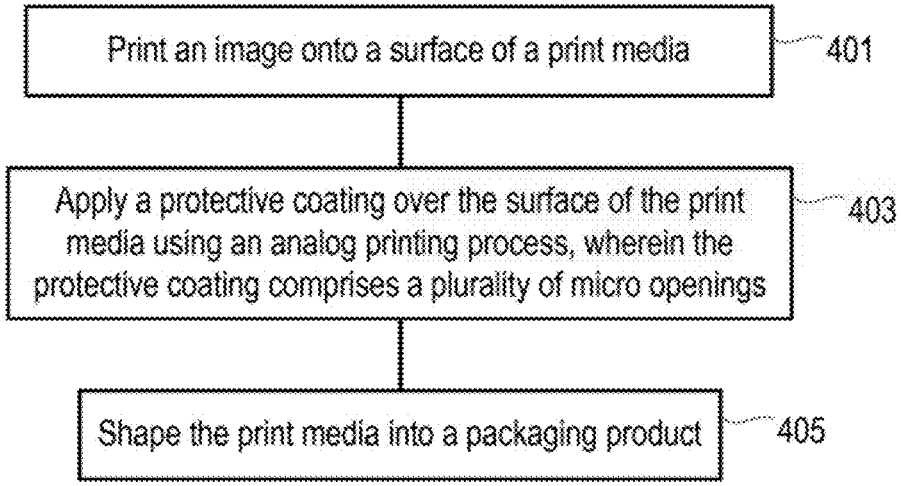
FIG. 4 shows an example of another method according to the present disclosure.

FIG. 4 shows an example of a method according to another example. The method of FIG. 4 relates to forming a packaging product from a print media.

The method comprises printing, 401, an image onto a surface of the print media, and applying, 403, a protective coating over the surface of the print media using an analog printing process, wherein the protective coating comprises a plurality of micro openings. The method further comprises shaping, 405, the print media into the packaging product.

In one example, prior to shaping the print media the method comprises depositing an adhesive over at least a portion of the protective coating.

Figure 5:
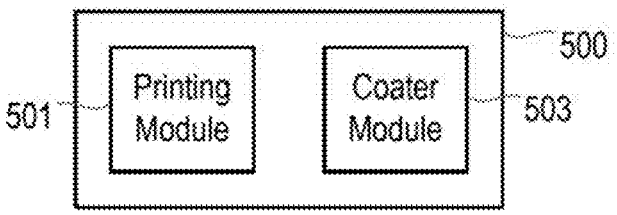
FIG. 5 shows an example of an apparatus according to the present disclosure.

FIG. 5 shows an example of an apparatus for printing a print media. The apparatus 500 comprises a printing module 501 to print an image onto a surface of a print media. The apparatus 500 comprises a coater module 503 to apply a protective coating over the surface of the print media using an analog coating process, wherein the protective coating comprises a plurality of micro openings.

In one example, the coater module 503 comprises a post printing coater module, for example a varnish press, that is arranged downstream of a printing process. In one example the post printing coater module is a small, low cost "flood" varnish press. The post coater module 503 may be arranged such that it does not print a 100% coverage varnish, and instead prints a predetermined percentage as discussed in other examples, wherein a plurality of micro openings are provided in the protective coating. In one example the coater module 503 uses AM (and/or FM) halftoning techniques to create non solid coverage of print material, such as varnish, over at least an area of the print media.

As mentioned above, the coater module 503 may use AM halftoning methods, such as cluster dot screening, to deposit the predetermined percentage of protective coating. In another example, FM halftoning methods may be used to select the density of the printed dots, for example using error diffusion techniques.

In some examples the coater module 503 comprises a roller or mesh comprising a plurality of micro openings.

The layer of protective coating described in the examples herein acts to protect the print media. The layer of protective coating can also act, in some examples, to add a gloss and/or increase the color gamut. On the other hand, by printing a protective coating that just covers a predetermined percentage of the print media it is being applied to, the protective coating still enables penetration of a subsequent coating, such as a glue or adhesive.

In some examples described herein, the stage of printing (and the printing module) comprises digital packaging printing. Digital packaging printing enables short-run packaging prints to be carried out economically (as well as being able to have each print unique, which is not possible with analog techniques). Short-runs or unique runs are not economically feasible with analog techniques because of the set-up time and costs However, analog printing techniques can still be more economic that digital printing techniques for long print runs. Examples described herein can therefore use digital packaging printing techniques to print imaged areas, in combination with an analog printing technique to apply a protective coating having a plurality of micro openings that enable a subsequent printing or gluing operation to be performed. Such a combination enables a more cost effective analog process to be used for applying a protective coating which remains the same over a particular print run (e.g. a long print run), while the digital packaging printing enables the printed images themselves to change during that particular print run. In this way the digital packaging printing can change ad-hoc, and the same analog printing process used to apply the protective coating over what has been printed digitally.

The examples described herein may use different materials as a protective coating, for example depending on a particular application. For example, different varnishes may be used at different screen rulings (distance between dots in AM screens) and different varnish thicknesses combinations can be provided. These combinations can balance between protection, gloss and gamut and between capabilities to glue with needed strength. In some examples to frequency may vary from 20 to 200 dpi. The examples may be used with any form of protective coating, including gloss, matt and semi-gloss varnishes, having different friction properties, or different mechanical properties such as flexibility or scratch resistance.

The ability of the protective coating to receive a subsequent coating (e.g. the "gluability" of the protective coating) may, in some examples, depend on the thickness of the protective coating, and/or the type of print media being used. In one example the protective coating layer can start from less than 70% area coverage.

Some examples enable standard or lower cost adhesives to be used during subsequent processing stages, which can be beneficial in situations where printers cannot dictate to their customers what kind of glues they should use in their packaging lines.

The examples described herein also have advantages over processes that add a digital varnish ink for a digital overcoat of the whole page, since the costs per copy (CpC) of such processes is higher, for example triple the cost of ink due to their 100% coverage.

The examples may be used in some examples to protect print media such as white day coated paper during subsequently handling, for example during packaging, including for example operations such as staking, cutting and folding (finishing process). Sheets of such print media are often stored in stacks during a packaging process. This print media is popular due to high quality and low cost, but without the print process mentioned above would be easily scratched during a box conversion process for example.

It should be noted that the above-mentioned examples illustrate rather than limit the present disclosure, and that many alternative examples may be designed without departing from the scope of the appended claims. The word "comprising" does not exclude the presence of elements or steps other than those listed in a claim, "a" or "an" does not exclude a plurality, and a single processor or other unit may fulfil the functions of several units recited in the claims. Any reference signs in the claims shall not be construed so as to limit their scope.

The invention claimed is:

1. A method of printing a print media comprising:

printing an image onto a surface of a print media, wherein the surface of the print media includes an imaged region containing the printed image;

applying a protective coating over the surface of the print media at the imaged region using an analog printing process, wherein the protective coating comprises a plurality of micro openings; and depositing an adhesive onto the applied protective coating to cause the adhesive to flow into the plurality of micro openings positioned over the imaged region.

2. The method as claimed in claim 1, wherein applying a protective coating comprises distributing the plurality of micro openings over the surface of the print media in an even manner, using a repeating pattern, or using an even average density.

3. The method as claimed in claim 1, comprising configuring the plurality of micro openings such that the protective coating deposits on:

10% to 70% of a surface area of the print media; or

30% of the surface area of the print media.

4. The method as claimed in claim 1, comprising configuring the plurality of micro openings based on at least one of the following criteria:

a print media type;

a protective coating type; or a subsequent coating type, wherein a subsequent coating is to be applied over at least a portion of the protective coating.

5. The method as claimed in claim 1, wherein applying a protective coating comprises depositing a protective coating having a predetermined thickness to the surface of the print media.

6. The method as claimed in claim 5, wherein the predetermined thickness is selected based on at least one of the following criteria:

a print media type;

a protective coating type; or a subsequent coating type, wherein a subsequent coating is to be applied over at least a portion of the protective coating.

7. The method as claimed in claim 5, wherein the protective coating comprises a thickness of between 0.5 μm to 4 μm.

8. The method as claimed in claim 1, wherein the analog printing process comprises:

depositing the protective coating using a roller coating process, wherein the roller comprises a pattern to form the plurality of micro openings in an applied protective coating; or depositing the protective coating using a mesh screen, wherein the mesh screen comprises a pattern to form the plurality of micro openings as the protective coating is deposited through the mesh screen.

9. The method as claimed in claim 1, wherein the plurality of micro openings form a protective coating comprising a plurality of printed dots or lines.

10. The method as claimed in claim 9, comprising using amplitude modulation halftoning techniques and/or frequency modulation halftoning techniques to control the size and/or density of the printed dots or lines and/or the size of the plurality of micro openings.

11. The method as claimed in claim 1, further comprising:

depositing the adhesive over at least a portion of the protective coating.

12. A method of printing a print media comprising:

receiving a print media having an image printed on a surface thereof;

applying a protective coating over the surface of the print media including the printed image using an analog printing process, wherein the protective coating comprises a plurality of micro openings and wherein the surface includes a fixing portion that is to be adhered to another portion of the print media; and depositing an adhesive over the protective coating that is applied over the surface of the print media including the printed image and on the fixing portion of the surface.

13. A method of forming a packaging product from a print media, the method comprising:

printing an image onto a surface of the print media, the surface including a fixing portion that is to be adhered to another portion of the print media;

applying a protective coating over the surface of the print media using an analog printing process, wherein the protective coating comprises a plurality of micro openings;

depositing an adhesive over the protective coating applied over the surface of the image including the printed image and on the fixing portion of the surface; and shaping the print media into the packaging product.

14. The method as claimed in claim 13, further comprising:

applying a lower percentage of the protective coating at the fixing portion than a portion of the surface other than the fixing portion.

15. An apparatus for printing a print media, the apparatus comprising:

a printing module to print an image onto a surface of a print media, wherein the surface of the print media includes an imaged region containing the printed image;

a coater module to apply a protective coating over the surface of the print media at the imaged region using an analog coating process, wherein the protective coating comprises a plurality of micro openings; and a module to deposit an adhesive onto the applied protective coating to cause the adhesive to flow into the plurality of micro openings positioned over the imaged region.

16. The method as claimed in claim 11, wherein the surface includes a fixing portion at which the print media is to be adhered, and wherein the method further comprises:

applying a lower percentage of the protective coating at the fixing portion than a portion other than the fixing portion.

17. The method as claimed in claim 12, wherein applying the protective coating using an analog printing process comprises:

depositing the protective coating using a roller coating process, wherein the roller comprises a pattern based on a plurality of micro openings; or depositing the protective coating using a mesh screen, wherein the mesh screen comprises a plurality of micro openings.

18. The method as claimed in claim 12, further comprising:

applying a lower percentage of the protective coating at the fixing portion than a portion of the surface other than the fixing portion.

19. The apparatus as claimed in claim 15, wherein the surface includes a fixing portion at which the print media is to be adhered, and wherein the coater module is further to apply a lower percentage of the protective coating at the fixing portion than a portion other than the fixing portion.

20. The apparatus as claimed in claim 15, wherein to apply the protective coating, the coater module is to:

deposit the protective coating using a roller coating process, wherein the roller comprises a pattern based on a plurality of micro openings; or deposit the protective coating using a mesh screen, wherein the mesh screen comprises a plurality of micro openings.

* * * * *